US005357651A

United States Patent [19]

Jones et al.

[11] Patent Number: 5,357,651

[45] Date of Patent: Oct. 25, 1994

[54] PROGRAMMABLE MULTI-DIRECTIONAL TROLLEY FOR WALL PANELS

[75] Inventors: Norman P. Jones, Petersburg; Michael L. Saathoff, Williamsville, both of Ill.

[73] Assignee: Kwik-Wall Company, Springfield, Ill.

[21] Appl. No.: 7,610

[22] Filed: Jan. 22, 1993

[51] Int. Cl.[5] ..... E05D 13/02; A47H 1/04

[52] U.S. Cl. ..... 16/95 R; 49/127; 49/409

[58] Field of Search ..... 16/87 R, 87.4 R, 95 R; 49/127, 409, 125

[56] References Cited

U.S. PATENT DOCUMENTS

| | | | |
|---|---|---|---|
| 3,052,000 | 9/1962 | Ferrett | 49/127 |
| 3,071,825 | 1/1963 | Ferris | 49/127 |
| 3,334,375 | 8/1967 | Hubbard | 49/127 |
| 3,879,799 | 4/1975 | Williams | 16/95 R |
| 4,302,865 | 12/1981 | Dixon et al. | 16/95 R |
| 4,555,828 | 12/1985 | Matimura | 16/87 R |
| 5,016,318 | 5/1991 | Harris | 16/95 R |
| 5,230,123 | 7/1993 | Williams et al. | 16/95 R |

FOREIGN PATENT DOCUMENTS 2166437 3/1974 Fed. Rep. of Germany ..... 49/127

*Primary Examiner*—Daniel C. Crane
*Assistant Examiner*—Donald M. Gurley
*Attorney, Agent, or Firm*—Robbins & Robbins

[57] ABSTRACT

A programming system is provided for passing or blocking the movement of operable room divider panels along overhead tracks supporting the panels. The programming system employs separate characterized gates which pass or deny passage to separate panels which are moved along the track. By providing gates at intersections panels from one track leg can be passed or blocked to one or more intersecting legs as desired. The gates may be in the form of keyed or characterized inserts at the intersections of tracks or channels supporting the panels. The inserts may have different keyed or characterized openings which receive mating guide pins on selected panels which permit passage past the gate and block panels having male guide pins with a different key or characterized configuration.

7 Claims, 2 Drawing Sheets

PROGRAMMABLE MULTI-DIRECTIONAL TROLLEY FOR WALL PANELS

BACKGROUND OF THE INVENTION

In the past operable multi-panel dividers have been conventionally employed in overhead carriage systems in various types of rooms to provide walled off areas of different configurations and designs. Such panels, as in the form of acoustical structural panels, have been employed in hotels, banquet halls, meeting halls and other buildings to divide out areas of different sizes depending on the demand.

The panels, in order to be maneuvered to the desired room plan, have generally been supported to be moved on overhead tracks or channels within which the panels are supported by wheeled trolleys or the like in order that they may be moved from a stack or staging area to the desired wall plan. The tracks are accordingly designed to have various layout or ceiling plan designs such as a grid with various intersections and paths to provide different meeting room areas and the like.

Problems have often arisen heretofore when two or more divider walls are to be formed in the same area. Confusion has occurred as to which stack area the panel is to be sent or which edge of the panel is the leading edge. In many cases the panel may be "flipped" or turned 180° in its passage through the various channels which should be avoided. A great amount of time and labor may be spent in straightening out improperly positioned panels.

SUMMARY OF THE INVENTION

By means of this invention, there has been provided a gate structure for programming the position of selected operable room divider wall panels for dividing an area into subdivided room areas as desired. The programming may be accomplished by utilizing existing overhead carriage track layouts by establishing gate structures at various track paths such as track intersections in order that guide paths to selected tracks may be established for the separate panels.

The programmable system utilizes the gates to block or pass selected panels in order that the panels may be guided along selected track paths and be blocked from entering undesired track paths. In order to provide different entry track paths, the gates are designed that they may be the same of different from one or more of the gates employed in the track programming. Likewise, the panels may have the same or different sensing or guide elements which will be passed through or blocked at the gate depending upon which type of gate is employed.

As an embodiment of the gate employed in the programmable panel positioning of this invention, a characterized gate opening may be used in a gate insert placed in a track channel commonly used in room divider layouts. The panels having conventional support trolleys which move along the track channels are provided with characterized or keyed guide pins which are designed to pass through in mating relations or be blocked by the opening in the gate inserts. The gate inserts may be simply installed or removed in any area of the track system. The placement is particularly well suited at track intersections, such as an X-crossing to establish track paths either through the crossing or for left or right turns according to the selected track and path program.

The track programming system and gate structures are simple in construction and easily installed or changed to provide different track programs. They provide a reliable and widely available provision for utilization in existing overhead carriage and panel room dividers.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
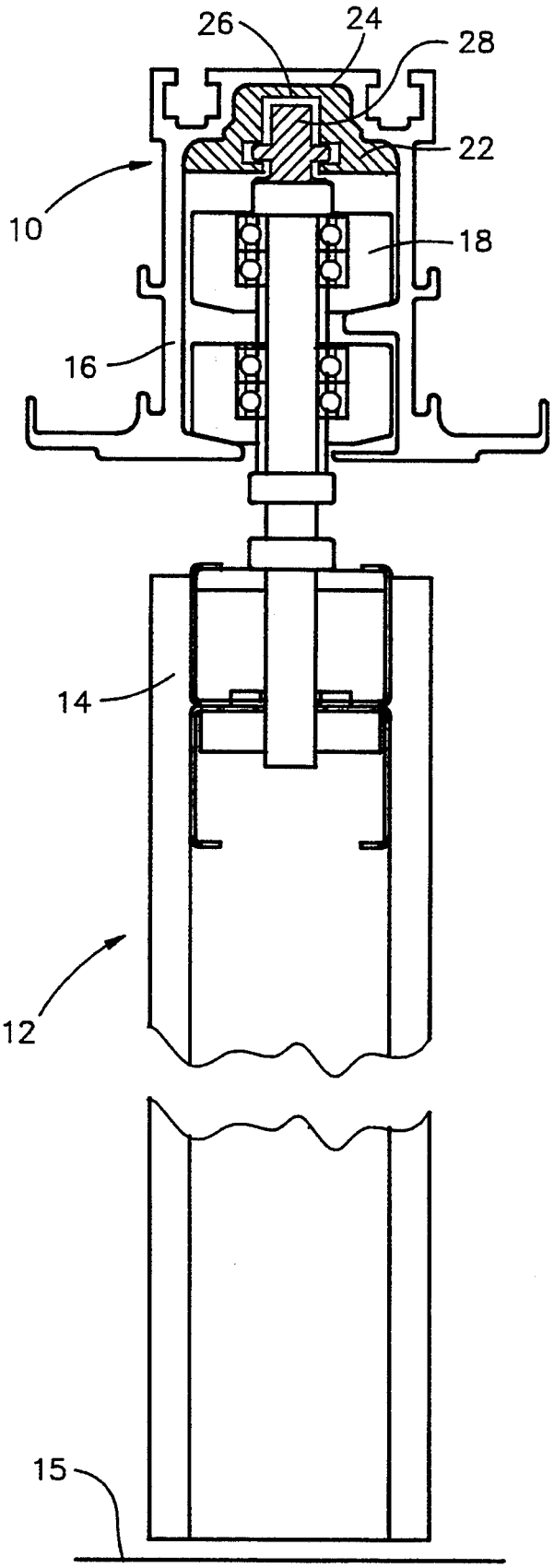
FIG. 1 is a view in transverse vertical section of an acoustical panel and trolley, and track channel provided with the programmable gate of this invention.
Figure 5A:
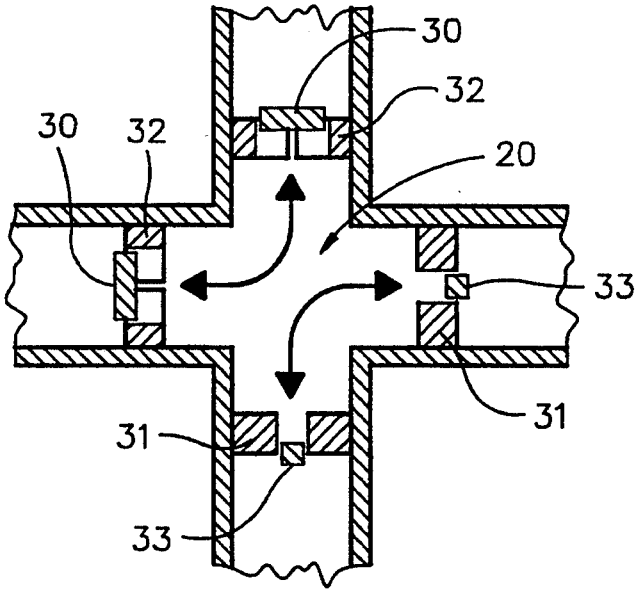
FIG. 5A is a schematic view showing a cross-intersection programmed for right angle turns only.
Figure 5B:
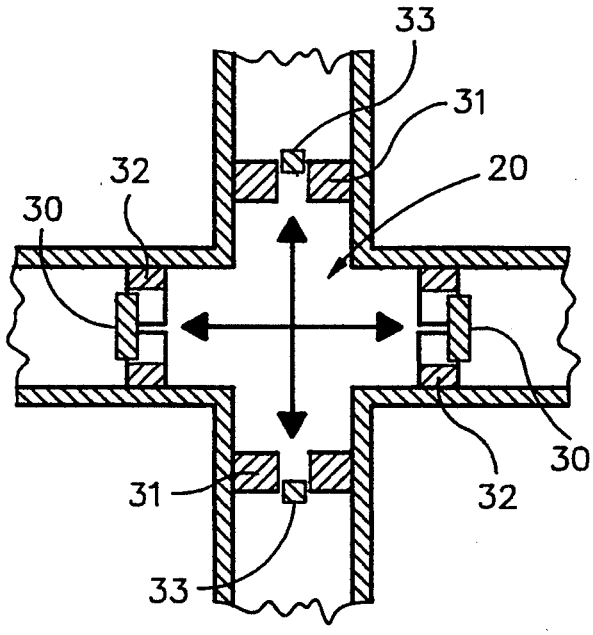
FIG. 5B is a view similar to FIG. 5A showing the intersection programmed only for straight through passage.

The programming system for selectively controlling the passage or blockage of room divider wall panels is shown generally by the reference numeral 10 in FIG. 1. It is employed with operable multi-panel room divider systems, shown generally by reference numeral 12, using a track layout for supporting trolleys attached to the panel as is well understood in the art. Referring to FIG. 1, panel 14 is slidably supported within track channel 16 by trolley 18. The tracking system is normally organized in a gridwork fashion, using X, L, T and Y intersections, thus creating several channel intersections such as intersection 20 as shown in FIGS. 5A and 5B.

The programming means of the instant invention comprises a gate in the form of an insert member 22 which is positioned within a top inside portion 24 of track 16 as shown in FIG. 1. The insert may, as an example, be in the form of an extruded aluminum insert.

The insert member 22 is secured within track 16 by a press or friction fit, whereby it may be simply knocked into or knocked out of the channel. Bolting, set screws or other conventional means, (not shown) will be readily apparent and may be used as desired. The insert may be removably secured so that it can be repositioned at various locations along the length of track 16. Insert member 22 can be constructed of any material but should have a sufficient dimension to allow for a characterized opening 26 in the form of a groove or slot to extend along and through its body parallel with the course of the track in which it is secured.

A vertically extending guide pin member 28 is provided on top of trolley 18. It acts as a male member and is freely and loosely received within opening 26 of female member insert 22. The configuration of insert 22 is such that unless guide pin member 28 can pass through opening 26, the divider wall panel will be blocked and prevented from passage beyond that point.

Insert member 22 is given selective control over passage and blockage of guide member 28 by varying the characterized configuration of opening 26 as seen in FIGS. 2A–2D, 3A–3C, and 4A–4B. Whether a panel will be allowed passage or be blocked is dependant upon the characterized configuration of guide member 28 and whether it has a congruently mating configuration with opening 26.

Figure 2A:
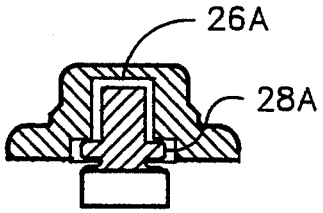
FIG. 2A is a view in transverse section through a gate insert and guide pin for a different program.
Figure 2B:
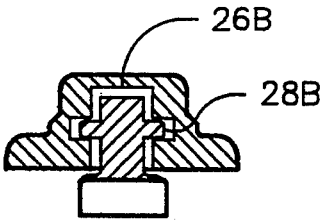
FIG. 2B is a view similar to FIG. 2A showing a different gate.
Figure 2C:
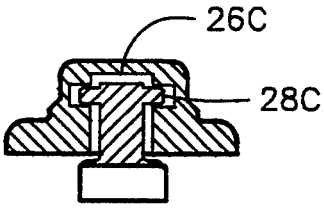
FIG. 2C is a view similar to FIG. 2A showing another gate.
Figure 2D:
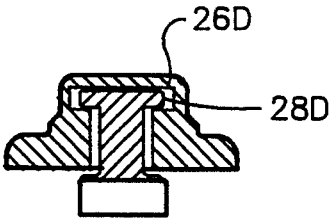
FIG. 2D is a view similar to FIG. 2A showing another gate.

FIGS. 2A–2D show an additional four positions of the cruciform guide pin 28 and opening 26 of the insert gate 22. FIG. 2A shows a guide pin 28A and gate opening 26A at the bottom of the insert gate, just below the position shown in FIG. 1. FIG. 2B shows a guide pin 28B and opening 26B just above the position of FIG. 1, while FIG. 2C shows guide pin 28C and opening 26C at a further elevated position and FIG. 2D shows guide pin 28D and opening 26D at the very top of the gate 22. Each of the aforementioned positions and with that shown in FIG. 1 establish a separate gate selection.

Figure 3A:
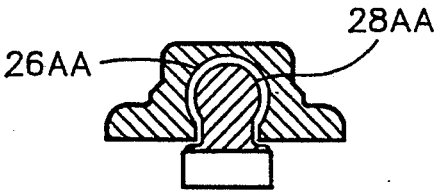
FIG. 3A is a view in transverse section through a characterized gate and guide pin in the form of a circular cross-section.
Figure 3B:
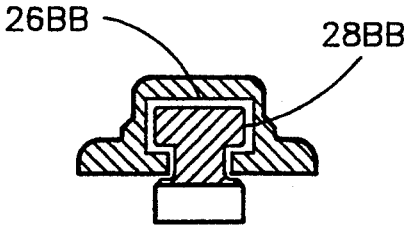
FIG. 3B is a view similar to FIG. 3A showing a characterized gate and guide pin in the form of a T-shaped cross-section.
Figure 3C:
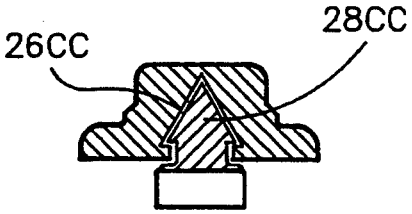
FIG. 3C is a view similar to FIG. 3A showing a characterized gate and guide pin in the form of a triangular cross-section.

FIGS. 3A through 3C, show additional geometrical forms of the gate openings and guide pins having differently shaped heads. FIG. 3A shows a guide pin 28AA having a circular cross-section with the female opening in the gate 22 having a congruent circular cross-section 26AA. The guide pin 28BB of FIG. 3B, has a thick rectangular shape while the gate opening 26BB is similarly shaped. In FIG. 3C, the guide pin 28CC and opening 26CC have a triangular shape.

Figure 4A:
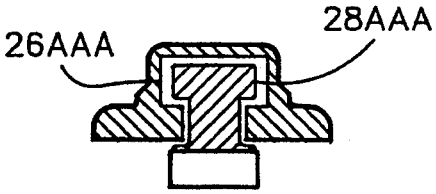
FIG. 4A is a view in transverse section through a gate and guide pin in the form of a Tee.
Figure 4B:
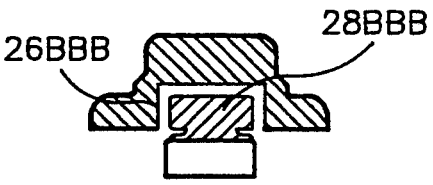
FIG. 4B is a view similar to FIG. 4A showing the guide pin and gate in a different position for a different program.

FIGS. 4A and 4B, show the use of rectangular heads in two different gate positions. FIG. 4A shows a guide pin 28AAA in an elevated position to mate with a gate opening 26A3 A while FIG. 4B shows a guide pin 28BBB mating with a gate opening 26BBB in a lower position.

FIGS. 5A and 5B portray an X intersection schematically and show how the movement of multi-panel dividers can be selectively controlled in right angles and straight through paths. Guide members 30, for example, would be denied access to any track leg of intersection 20 except that shown for gate inserts 32 because they would not have a congruent configuration with guide members 30. Insert members 32, however, would allow passage of guide members 30 because they have a specific configuration that is matingly congruent. Insert members 31, on the other hand, would allow passage of guide members 33 because they loosely mate in specific congruent relationship.

Various changes and modifications may be made within this invention as will be apparent to those skilled in the art. Such changes and modifications are within the scope and teaching of this invention as defined in the claims appended hereto.

What is claimed is:

1. In a multi-panel room divider system having a plurality of panels and channels supporting trolleys attached to said panels for moving said panels along said channels to different areas in a room, said trolleys having wheels engaging said channels, the improvement comprising programming means for blocking or passing said panels on said channel, said programming means comprising characterized gate means for blocking or passing said panels past said gate means, said gate means passing or blocking said panels responsive to characterized guide means on separate panels, said gate means comprising a characterized female member attached to said channel and receiving in mating relation a correspondingly characterized male guide means member, said guide means member being supported upon and extending from said trolleys in spaced relation from the wheels of the trolleys.

2. The multi-panel room divider system of claim 1 in which said gate means is an insert member removably secured within said channel.

3. The multi-panel room divider system of claim 2 in which said insert is provided with a characterized opening and said male guide member is supported above said panel and is congruent with said female member and is loosely receivable therethrough.

4. The multi-panel room divider of claim 1 in which said characterized female member is a characterized slot axially aligned with said channel and said characterized male guide member is congruent with said characterized slot and is loosely receivable therein.

5. The multi-panel room divider of claim 1 in which said gate means comprises at least one gate being responsive to a gate guide means carried by at least one panel to pass said panel by said gate means and a second gate responsive to a separate gate guide means carried by a different panel.

6. The multi-panel room divider of claim 1 in which at least one of said gate means is positioned on a first channel at an intersection having at least three channels whereby said first channel is programmed to pass or block panels.

7. The multi-panel room divider of claim 6 in which said gate means is positioned in said first channel in spaced relation from and is separate from said intersection.

* * * * *